United States Patent [19]

Norwood

[11] 3,996,839

[45] Dec. 14, 1976

[54] HYDRAULIC POSITIONING CYLINDER

[76] Inventor: Glen A. Norwood, 710 Maplewood Ave., Kent, Wash. 98031

[22] Filed: May 23, 1973

[21] Appl. No.: 354,185

[52] U.S. Cl. ..... 91/388; 91/460; 92/108

[51] Int. Cl.[2] ..... F15B 13/16; F15B 17/02; F01B 31/00

[58] Field of Search ..... 91/388, 358 A, 358, 91/460; 92/108

[56] References Cited

UNITED STATES PATENTS

| | | | |
|---|---|---|---|
| 3,063,425 | 11/1962 | Vier et al. | 91/388 |
| 3,164,065 | 1/1965 | Frantz | 91/388 |
| 3,511,133 | 5/1970 | Day | 91/388 |
| 3,710,689 | 1/1973 | Henderson | 92/108 |
| 3,772,962 | 11/1973 | Suzuki | 91/388 |
| 3,831,491 | 8/1974 | Thomas | 91/460 |
| 3,838,629 | 10/1974 | Meyers | 91/460 |

*Primary Examiner*—Paul E. Maslousky
*Attorney, Agent, or Firm*—Dowrey & Cross

[57] ABSTRACT

The positioning of the piston rod of a double acting hydraulic cylinder is accurately controlled by means of applying hydraulic pressure, created by the controlled displacement of a fluid independent from the primary fluid system, against the piston of a servo-cylinder which controls the servo-valve for the double acting cylinder. As the piston rod of the double acting cylinder moves, the pressure on the servo-cylinder is relieved and the servo-cylinder is returned to a balanced condition, restoring the neutral position of the servo-valve. In another embodiment the application of pressure to a fluid system independent from the primary fluid system is sensed by an electro-hydraulic transducer and a proportional electric signal is produced for controlling the electro-hydraulic servo-valve of the double acting cylinder. As the piston rod of the double acting cylinder moves, fluid is displaced, relieving the sensed pressure and returning the servo-valve to a neutral position at a new setting of the piston rod.

7 Claims, 4 Drawing Figures

ELECTRO-HYD SERVO VALVE
ELECTRO HYD TRANS
SOL
SOL VALVE N.C.
SOL VALVE N.C.
P
P-1
T

HYDRAULIC POSITIONING CYLINDER

BACKGROUND OF THE INVENTION

The present invention relates to an improved control system for hydraulic positioning devices such as used in what is commonly termed setworks for setting the position of such equipment as machine tools, saws, chippers and edges utilized in the wood products industries, and various other applications. Commonly, these systems are a combination of mechanical and/or hydraulic linkages which make available a given number of set positions to the appliance they control. The present invention is especially directed to improvements in a setworks system which is totally hydraulic wherein two circuits are used, one to control the other with a follow-up function linking the two.

Prior systems of the type under consideration have been inadequate in many respects and, additionally, require quite complex and cumbersome apparatus. One particular problem has been in the nature of the apparatus needed to perform the follow-up function between the control circuit and the power circuit. In the past, some external apparatus was necessary, such as a traveling rod or operator, to follow the motion of the power cylinder so as to reset or neutralize the control linkage when a particular set position was reached. Other problems experienced with hydraulic systems are the difficulties of calibration and compensation for temperature changes and seal leakage.

The present invention seeks to alleviate the shortcomings of the prior art systems by the provision of a dual circuit hydraulic system wherein the follow-up function is accomplished by a structure internal to the double acting cylinder, thus eliminating the necessity for any push rod apparatus or the like. In addition to this advantage, a unique arrangement is provided for temperature and seal leakage compensation and recalibration. Electrical controls are also provided for the dual circuit system whereby the number and combination of sets may be easily and rapidly changed for increased flexibility.

Accordingly, the primary object of the present invention is to provide a hydraulic positioning device comprising separate control and power circuits wherein the follow-up function between the control and power circuits is accomplished by a structure completely internal to the power cylinder.

Another object of the present invention is to provide a hydraulic positioning device of the character described which may be easily calibrated to compensate for temperature changes and seal leakage.

Another object of the present invention is to provide a hydraulic positioning device of the character described which is controlled by an electrical system enabling changes to be made in the number and combination of sets in a rapid and simple manner.

These and other objects and advantages of the invention will be apparent from the following specification and claims and from the accompanying drawings wherein:

DESCRIPTION OF THE PREFERRED EMBODIMENT

Figures 1, 1A:
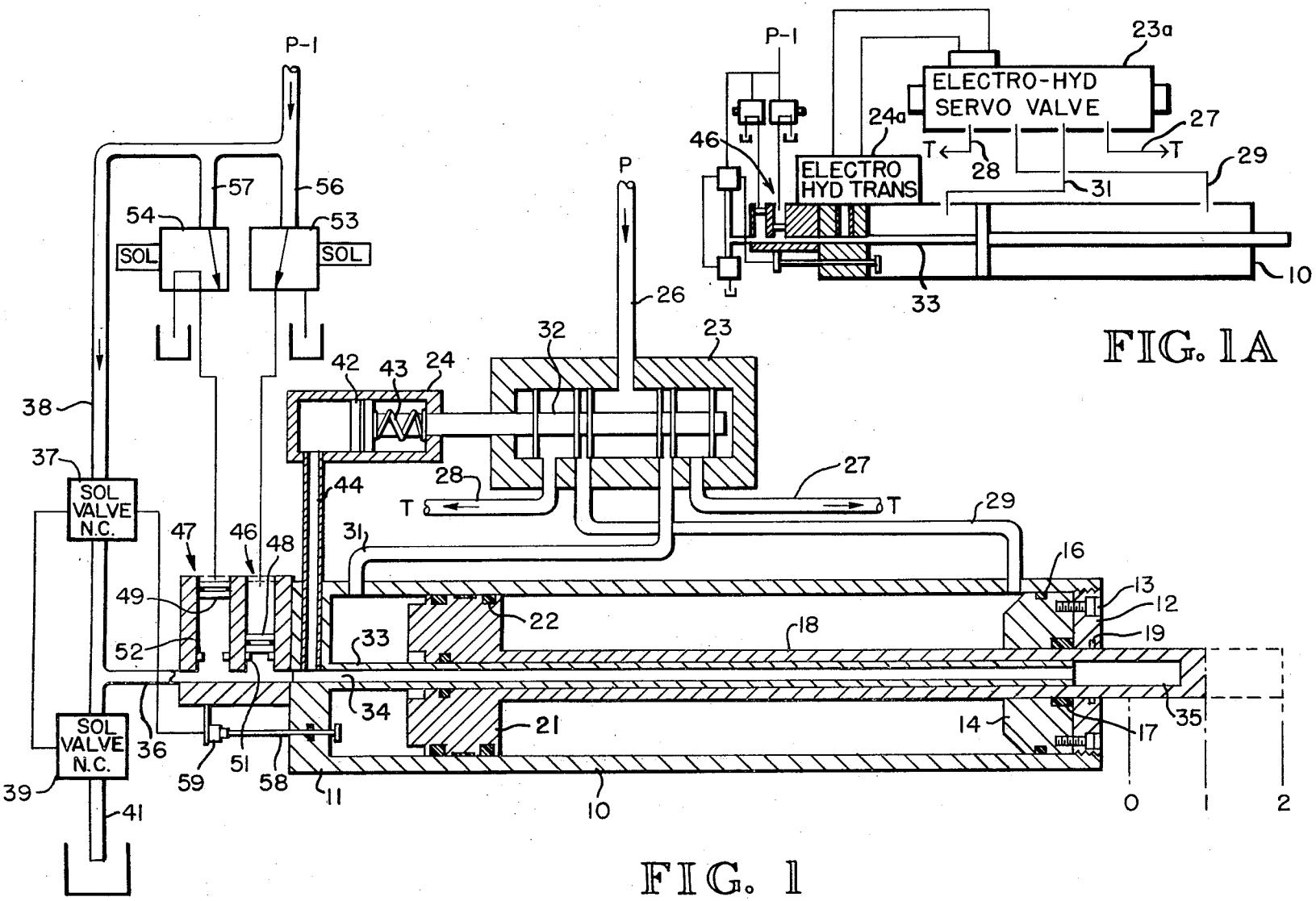
FIG. 1 is a schematic view of the power cylinder and hydraulic circuits.
FIG. 1A is a schematic view of a modified form of the invention showing the power cylinder and hydraulic circuits.

Referring now to the drawings, and particularly to FIG. 1, the device comprises a double acting hydraulic cylinder 10 having a stationary end wall 11 and a screw threaded removable opposite end wall 12. The end wall 11 is adapted to accommodate the conduits for a control circuit, as will be presently explained, and the end wall 12 is provided with set screws 13 for retaining the plug 14. The plug 14 is fitted with an O-ring seal 16 and a suitable fluid seal 17 which surrounds the piston rod 18. The end wall 12 may also be provided with a seal member or packing 19 which accommodates reciprocation of the piston rod 18. The piston rod 18 is connected to the piston member 21 which is permitted to reciprocate within the cylinder 10 in a more or less conventional manner when one side or the other of the piston is pressurized. The piston 21 may be provided with any conventional form of fluid seals 22.

Fluid pressure for the power cylinder 10 is provided by a fluid pressure source such as a hydraulic pump indicated at P in FIG. 1. The servo-valve 23 controls the movement of the piston 21 and comprises a spool valve controlled by the servo-cylinder 24. High pressure fluid is admitted to the valve 23 by the conduit 26, and conduits 27 and 28 connect the valve body to tank or sump. The two conduits 29 and 31 connect the valve body 23 to the opposite ends of the double acting cylinder 10. As seen in FIG. 1, the lands of the valve spool 32 are positioned so that the piston 21 is in the balanced or stationary position with the pressure conduit 26 and the conduits 29 and 31 being blocked and the piston rod 18 in a given set position.

The piston rod 18, as well as the piston member 21, have a cylindrical bore 35 which telescopingly receives the pressure conduit 33 which communicates with a passage 34 in the end wall 11. The passage 34 is connected to the control fluid passage 36. The passage 36 is connected to a second source of fluid pressure which comprises the control pressure, indicated at P-1, through a first normally closed solenoid valve 37 in conduit 38. The passage 36 is connected to the tank or sump via a second normally closed solenoid valve 39 and the conduit 41. The function of the solenoid valves 37 and 39 will be described in detail in connection with the recalibration feature of the system.

As previously described, the servo-cylinder 24 controls the positioning of the valve spool 32 for the power cylinder. The cylinder 24 has a piston 42 connected to the stem of the valve spool and is biased to the left, as shown in FIG. 1, by means of the spring 43. The other side of piston 42 is exposed to the control pressure by means of the conduit 44 which is in communication with the passage 34. It will thus be seen that the volume of liquid or hydraulic fluid in the conduits 33, 34, 36, and 44, along with that of the fluid in the left hand side of servo-cylinder 24, is fixed so that the pressure thereof determines the position of the valve spool 32. The volume of control fluid (and hence the pressure thereof) may be accurately controlled by means of a plurality of control units, two of which are illustrated at 46 and 47 in FIG. 1, in the form of hydraulic cylinders with floating pistons capable of displacing a controlled amount of the hydraulic fluid in the control passages. Although only two such control cylinders are indicated, it will be understood that any number of these cylinders may be used to form different combinations of volume displacements to provide flexibility for the number of set positions desired. This feature will be explained later in connection with the system illustrated in FIGS. 2 and 3.

The cylinders 46 and 47, as well as any other of the multiple control cylinders, may be substantially identical in structure except for size and displacement capacity. The cylinders 46 and 47 are provided with floating pistons 48 and 49, respectively, which are exposed on their bottom faces to the control fluid in the passage 36. In order to accurately control the volume of fluid displaced, limit stops 51 and 52, respectively, are provided for the control cylinders to limit the downward travel of the pistons. The pistons will be either in their upper limit position or lower limit position, depending upon whether the top face of the piston is connected to the control pressure source P-1 or to sump. The two position solenoid valves 53 and 54 are located in the control pressure lines 56 and 57 and are so designed that when the solenoid is energized, the valve is moved to admit control pressure to the upper face of the associated piston. When the solenoid is de-energized, the upper face of the control piston is placed in communication with sump and the pressure thereby relieved.

As viewed in FIG. 1, the piston rod 18 is shown in solid lines in what will be termed the number one (1) set position. Piston rod 18 is moved between set positions 0, 1 and 2 by selectively increasing and decreasing the control fluid volume (and hence decreasing and increasing the fluid pressure thereof), through appropriate actuation of pistons 48 and 49 by valves 53 and 54, respectively. Servo-cylinder 24 responds to the change in control fluid pressure and causes piston rod 18 to be extended or contracted until it achieves a new set position at which the control fluid pressure is restored to its original level — an increase in control fluid volume (i.e. a decrease in control fluid pressure) causing contraction of piston rod 18, and a decrease in control fluid volume (i.e. an increase in control fluid pressure) causing extension of piston rod 18.

The FIG. 1 position of the piston rod 18 has been achieved by subjecting the top face of the piston 48 to control pressure by energization of the solenoid valve 53. To contract or return the piston rod 18 to the 0 set position indicated, the control fluid volume is increased by deenergizing solonoid valve 53 and allowing the pressure to be relieved from the top side of the piston 48 which thus is allowed to retact. The increase in control fluid volume produced by retraction of piston 48 in turn relieves pressure on the left side of the servo-cylinder piston 42 so that spring 43 is now able to shift spool valve 32 to the left. As valve 32 shifts in this manner, fluid will be directed via conduit 29 to the right side of double acting piston 21, while simultaneously the opposite side of piston 21 will be connected with exhaust, thereby causing piston 21 to move to the left. As piston 21 moves to the left, rod 18 contracts and telescopes on the tube 33 which serves to decrease the volume of control fluid and thereby increase control fluid pressure against the left hand side of the servo-cylinder piston 42. With sufficient leftward movement of piston 21, the control fluid pressure applied to the left hand side of servo-cylinder piston 42 again corresponds to the original control fluid pressure which then overcomes the bias of spring 43 to shift the servo-cylinder piston 42 and spool valve 32 to the right until both are returned to their illustrated equilibrium positions. The ports leading to conduits 29 and 31 are now blocked and the piston rod 18 is held at set position 0. Likewise, moving from set position 1, as indicated in FIG. 1, to set position 2, in the condition of the system as shown, would require the rod 18 to be extended by decreasing the control fluid volume (i.e. increasing the control fluid pressure). This is accomplished by actuating solenoid valve 54 in order to subject the top side of piston 49 to the control pressure and cause it to move downward to its lower limit position. The increase in control fluid pressure produced by the resultant decrease in control fluid volume creates an unbalancing pressure against the piston 42 which thus overcomes the bias of spring 43 and moves spool valve 32 to the right, thereby subjecting conduit 31 to the high pressure conduit 26 while subjecting conduit 29 to exhaust. This results in movement of the piston 21 to the right, as viewed in FIG. 1, to extend piston rod 18 and telescope it on the conduit 33, thereby increasing the control fluid volume. With sufficient rightward movement of piston 21, the pressure inbalance of the piston 42 is again relieved so that, upon restoration of the original control fluid pressure, the spring 43 now moves piston 42 to the left and returns it along with spool valve 32 to their illustrated equilibrium positions. Once again, the ports leading to conduits 29 and 31 are blocked, except now piston rod 18 is held at set position 2. To move piston rod 18 from set positions 0 or 2 to set position 1, the pistons 48 and 49 are operated by valves 53 and 54 to decrease and increase the control fluid volume, respectively, to produce extension or contraction of rod 18 in a generally similar manner.

Although, for all practical purposes, liquid may be said to be incompressable and thereby provide an exact measured volume of displacement which is predictable and repeatable, such factors as seal leakage and temperature will adversely affect the accuracy of the system under consideration. The present system incorporates a self-calibrating feature which recharges the control volume circuit through a micro-switch signal to correct for any fluid loss due to seal leakage or temperature changes. This is accomplished by the normally closed solenoid valve 37 in the conduit 38 which is actuated and opened any time the piston 21 moves to the fully retracted or extreme left end of the cylinder 10. The piston 21 contacts the switch operator 58 which operates the microswitch 59, to energize the solenoid valve 37. The control volume circuit is thus subjected to the full pressure from the source P-1 which will move the piston 21 to the right as viewed in FIG. 1 until the operator 58 is released. At this point, however, the piston rod 18 is at the 0 set position with any loss of fluid volume being restored.

In order to compensate for a gain in control fluid volume, a manually operated, normally closed solenoid valve 39 is provided in the line 41. If the operator desires to recalibrate the system because of a gain in fluid volume, he merely actuates the valve 39 which serves to dump the control fluid circuit resulting in the piston 21 moving to the extreme left which actuates the micro-switch 59 resulting in a recharging of the system with control fluid from the source P-1 as previously described. The system is then ready to start from the 0 set position.

Figure 2:
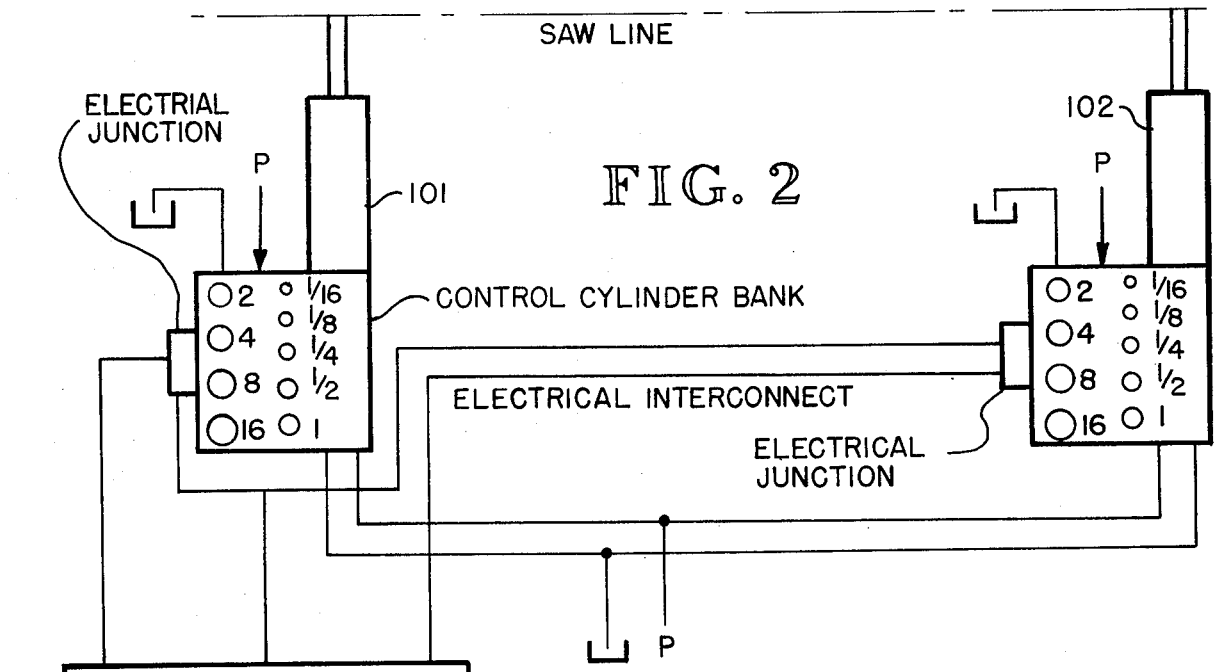
FIG. 2 is a schematic of the electrical control system.
Figure 3:
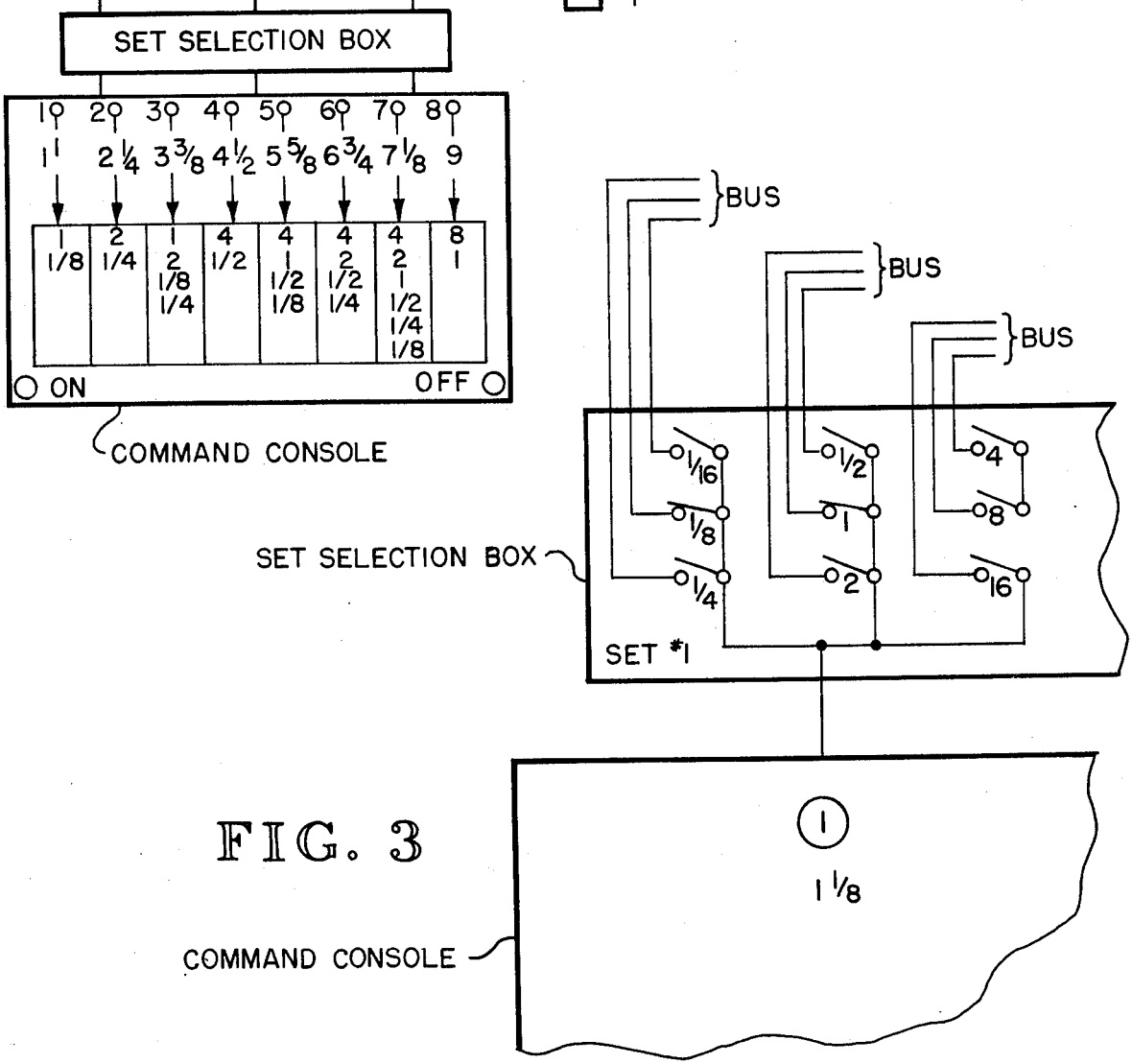
FIG. 3 is a detailed schematic of the command console and set selection box.

FIGS. 2 and 3 illustrate one possible installation of the control system as applied to saw line set works utilizing an 8 set selection with a total of 9 control cylinders such as the cylinders 46 and 47 illustrated in FIG. 1. As shown diagramatically in FIG. 2, each positioning cylinder 101 and 102 will be equipped with nine control cylinders of differing volumetric displacements which are calibrated to reduce movement of the related piston rod as indicated in terms of inches. These control cylinders may be mounted in a control cylinder bank and supplied with the control fluid pressure source P-1 as previously described. In order to provide the operator with a combination of prearranged set positions, a command console is utilized and, in this illustration, provides 8 different set positions determined by different combinations of the nine possible control cylinder displacements. Considering position No. 1 as an example, this position may be set at 1⅛ inch movement of the piston rod by selecting to actuate control cylinders having a pre-calibrated displacemnt which will result in 1⅛ inch movement of the cylinders 101 and 102. This would be accomplished by the arrangement shown in FIG. 3 wherein depression of the No. 1 position button serves to close the circuits through the solenoid valves for the 1 inch and ⅛ inch control cylinders. Likewise, other combinations may be obtained as illustrated in FIG. 1 for the other 7 set positions. These combinations can, of course, be rearranged to get a wide variety of set positions as desired.

FIG. 1A shows a modification of the basic system of FIG. 1 wherein the servo-cylinder 24 and the servovalve 23 are replaced by an electro-hydraulic transducer 24*a* and an electrohydraulic servo-valve 23*a*. The remaining components of the system will remain essentially the same with the only functional difference being that the servo-valve for the power cylinder 10 will be controlled in response to a proportional electrical signal produced by the transducer 24*a*. Both the transducer 24*a* and the servovalve 23*a* are conventional, commercially available units well known to the art. One example of an electro-hydraulic transducer of the type under consideration is disclosed in U.S. Pat. No. 3,569,767 which constitutes a piezoelectric device for converting physical forces into an electric signal. The unit will, of course, be supplied by a remote electrical power supply. This device is manufactured by Kistler Instrument Company, Overlake Industrial Park, Redmond, Wash. and known as the "Kistler 205 Series Piezotron". Since the structural details of the device are prior art knowledge and form no part of the present invention, the unit is illustrated in schematic form only in FIG. 1A. The electrohydraulic servo-valve 23a is likewise a well known commercially available unit capable of being adapted to the system by anyone skilled in the art and hence the structural details are omitted from this specification. Typical commercially available electrohydraulic servo-valves of the type under consideration are the model of 45–28 "Dyval" servo-valve manufactures by Dynamic Valves, Inc. 2630 Fayette Dr., Mountain View, Calif. and the model S-4C Allied Control servo-valve manufacturers by Allied Control Company, Inc., Plantsville, Conn.

In operation of the arrangement shown in FIG. 1A, it will be understood that the transducer 24*a* will always be subjected to the line pressure in the conduit 34. The electrical signal developed by this pressure will determine the null or centered position of the spool of the valve 23*a*. Any increase or decrease in this pressure will result in a proportional electrical signal effective to move the valve from the null position to open one or the other of the conduits 29 and 31 to high pressure conduit 26 and the remaining one to sump.

This results in movement of the piston rod 18 hence restoring the normal line pressure in conduit 34 and moving the servo valve 23*a* again to the centered or null position as previously described relative to FIG. 1.

While the preferred form and one modification of the hydraulic positioning device has been illustrated and described, it should be understood that further variations and alterations will be apparent to those skilled in the art without departing from the principles of the invention. Accordingly, the invention is not to be limited to the specific form illustrated, but rather is to be limited only by a liberal interpretation of the claims appended hereto.

The embodiments of the invention in which an exclusive property or privilege is claimed are defined as follows:

1. In a hydraulic system including a power cylinder having double acting piston means, and servo-valve means for applying fluid pressure to said power cylinder to produce movement of said piston means, the combination therewith of a servo-control system for controlling the position of said piston means, the servo-control system comprising; control fluid conduit means cooperating with said piston means for forming a fluid chamber adapted to contain a fixed volume of control fluid and for varying the pressure of said control fluid by varying the volume of said chamber in response to movement of said piston means, control means in communication with said chamber for selectively varying the pressure of said control fluid from an original pressure by varying the volume of said chamber independently of said piston means, and fluid pressure responsive sensing means connected to said control fluid conduit means and to said servovalve means for operating the servo-valve means in response to changes in the pressure of the control fluid to produce such movement of said piston means that the associated change in volume of said chamber causes the control fluid pressure to change sufficiently to offset the change in control fluid pressure caused by operation of said control means, whereby the piston means will be moved from an original setting to a new setting spaced from the original setting a distance related to the change in volume of said chamber needed to restore the original control fluid pressure.

2. The combination according to claim 1 wherein; said control means comprise means for providing selectively variable displacement fluid control chambers connected to said control fluid conduit means such that the fluid displacement of said chamber may be varied to operate said fluid pressure responsive sensing means and said servo-valve means to control movement of the piston means, the servo-control system being returned to a balanced condition by movement of the piston means to compensate for the pressure decrease or increase caused by the change in displacement of said chamber.

3. The combination according to claim 1 wherein; said fluid pressure responsive sensing means comprises a servo-cylinder having a movable member therein connected to operate said servovalve means, said movable member being spring biased in one direction and exposed to the control fluid pressure in the opposite direction.

4. The combination according to claim 2 wherein; said fluid pressure responsive sensing means comprises a servo-cylinder having a movable member therein connected to operate said servo-valve means, said movable member being spring biased in one direction and exposed to the control fluid pressure in the opposite direction.

5. The combination according to claim 1 wherein; the piston means comprises a hollow tubular member extending from one end of said cylinder and being closed on the outer end thereof and said control fluid conduit means comprises a stationary tubular conduit extending through the other end of said power cylinder and telescopingly received by said member, said stationary conduit and said member cooperating to form said fluid chamber upon movement of the member.

6. A hydraulic control system comprising, in combination; a double acting hydraulic cylinder, a piston member located in said cylinder and including a hollow piston rod extending from one end of the cylinder and being closed at its outer end, a stationary conduit member extending through the opposite end of said cylinder and telescopingly received in said hollow piston rod, forming a variable volume fluid chamber, servo-valve means, conduit means connecting said servo-valve means to a source of hydraulic pressure and to said cylinder, a servo-cylinder having a fluid pressure chamber in communication with said stationary conduit member and a piston member therein connected to operate said servo-valve means, the piston member of the servocylinder being spring-biased in one direction and subject to the fluid pressure in said chamber in the opposite direction, means for providing a plurality of control fluid chambers in communication with said stationary conduit member, means to selectively control the volume of fluid in each of said control chambers, said stationary conduit member, control fluid chambers, and the fluid pressure chamber of the servo-cylinder being adapted to contain a fixed quantity of control fluid, the piston of said servo-cylinder having a balanced position maintained by the spring bias acting against said control fluid wherein the hydraulic pressure source is blocked from said double acting cylinder and the piston rod is in a set position, whereby said servo-cylinder may be selectively actuated by controlling given ones of said control chambers to cause movement of the piston rod of the double acting cylinder, and the system being rebalanced by movement of said rod to a set position in which the volume of said chamber is changed sufficiently to accomodate a decrease or increase in the control fluid volume produced by said given ones of said control chambers.

7. In a hydraulic system including a power cylinder having double acting piston means, and servo-valve means for applying fluid pressure to said power cylinder to produce movement of said piston means, the combination therewith of a servocontrol system for controlling the position of said piston means, the servo-control system comprising; control fluid condit means cooperating with said piston means for forming a fluid chamber adapted to contain a fixed volume of control fluid and for varying the pressure on said control fluid by varying the volume of said chamber in response to movement of said piston means, control means in communication with said chamber for selectively varying the pressure of said control fluid by varying the volume of said chamber independently of said piston means, and fluid pressure responsive sensing means connected to said control fluid conduit means and to said servo-valve means for operating the servo-valve means in response to changes in the pressure of the control fluid to produce such movement of said piston means that the associated change in volume of said chamber causes the control fluid pressure to change sufficiently to offset the change in control fluid pressure caused by operation of said control means, whereby the piston means will be moved from an original setting to a new setting spaced from the original setting a distance related to the change in volume of said chamber needed to restore the original control fluid pressure;

first normally closed valve means for selectively supplying control fluid to said control fluid conduit means, valve operating means located in said power cylinder and connected to operate said first normally closed valve means, said valve operating means being positioned to be contacted by said piston means upon travel thereof beyond a predetermined position of travel to open said first normally closed valve means, and second normally closed valve means for selectively discharging control fluid from said control fluid conduit means to a reservoir, whereby said fixed volume of control fluid may be maintained at a constant level regardless of leakage and temperature change.

* * * * *